United States Patent [19]

Bostwick

[11] Patent Number: 4,889,092

[45] Date of Patent: Dec. 26, 1989

[54] FUEL VISCOSITY/DENSITY COMPENSATION DEVICE

[75] Inventor: Norvan W. Bostwick, Longmeadow, Mass.

[73] Assignee: AIL Corporation, Columbia, S.C.

[21] Appl. No.: 756,471

[22] Filed: Jul. 18, 1985

[51] Int. Cl.[4] ..... F02M 39/00

[52] U.S. Cl. ..... 123/381; 123/387

[58] Field of Search ..... 123/387, 385, 386, 357–359, 123/381

[56] References Cited

U.S. PATENT DOCUMENTS

| | | | |
|---|---|---|---|
| 2,996,053 | 8/1961 | Evans | 123/381 |
| 3,170,503 | 2/1965 | Isley | 123/381 |
| 3,204,623 | 9/1965 | Isley | 123/381 |
| 3,215,185 | 11/1965 | Black | 123/381 |
| 3,241,596 | 3/1966 | Isley | 123/381 |
| 3,338,224 | 8/1967 | Isley | 123/381 |
| 3,483,855 | 12/1969 | Thoma | 123/381 |
| 4,212,279 | 7/1980 | Ohanti | 123/357 |
| 4,222,713 | 9/1980 | Dekeyser | 123/381 |
| 4,308,834 | 11/1982 | Eheim | 123/387 |
| 4,384,560 | 5/1983 | Jäger | 123/387 |
| 4,512,308 | 4/1985 | Höfer | 123/387 |

OTHER PUBLICATIONS

Simmonds, "Automotives Industries", Simmonds Fuel Injection Systems, Nov. 15, 1957, pp. 117–118.

*Primary Examiner*—Carl Stuart Miller

*Attorney, Agent, or Firm*—Richard D. Weber

[57] ABSTRACT

Apparatus and a method for effecting fuel viscosity/-density compensation are disclosed. A combination of fuel flow through a viscosity sensitive annular orifice and a swirl-type orifice are utilized to create pressure differentials for driving a piston for regulating fuel flow. The components are positioned such that the direct variation of pressure drop across the annular flow orifice with viscosity change and the inverse variation of pressure drop across the swirl orifice with viscosity change, are combined to create an increased force for achieving the desired control effect.

5 Claims, 2 Drawing Sheets

FUEL VISCOSITY/DENSITY COMPENSATION DEVICE

BACKGROUND OF THE INVENTION

This invention relates to a fuel viscosity/density compensation device suitable for use with a fuel injection pump capable of supplying many types of fuel to an engine. More particularly this invention concerns the creation of an output signal for adjusting fuel flow based upon the viscosity of the fuel being utilized.

Certain internal combustion engines known as multi-fuel engines may be operated using a variety of fuels ranging from light fuels, such as gasoline, to heavy oils. Fuel injection pumps meter fuel into such engines on a volumetric basic without regard for the condition or thermal characteristics of the fuel. However, for a given throttle setting, the heat energy supplied to the engine and resulting power output may vary 20% or more depending upon the type of fuel used and the temperature and the viscosity of the fuel. Variations in fuel temperature cause changes in the density and consequently the thermal content of the fuel. More viscous fuels are also less subject to internal leakage in the injection pump. Hence, viscosity directly affects engine performance in several ways.

During operation of a multi-fuel engine at less than maximum power, compensation for changes in fuel conditions and characteristics may be made by adjustment of the throttle to maintain a desired engine output. Such compensation may be effected manually or by means of a govenor. However, at full load the throttle advance is limited by a full load stop which may have been manually set for each fuel used in accordance with the thermal capacity of the engine. Adjustment of the full load stop for each fuel employed is necessary to prevent overloading or to ensure the availability of maximum engine power. For example, if the full load stop were adjusted to provide rated engine output with diesel fuel, then if the engine were operated with gasoline, which has a lower heat content and is less viscous, the maximum output of the engine would drop substantially. On the other hand, if the full load stop were adjusted to provide rated output using gasoline as fuel, the engine could be overloaded and possibly damaged if operated with fuel oil.

Additionally it is not uncommon for the temperature of the fuel to change significantly under various operating conditions. The temperature of the fuel affects the density which also affects the volumetric amount of fuel available to the engine at the full load stop. Hence, any system for varying the volumetric amount of fuel supplied to the engine under full load conditions is likewise capable of adjusting for temperature conditions as well as changes in the fuel.

Previous attempts have been made to provide fluid density and viscosity control for use with fuel injected engines. In U.S. Pat. No. 3,215,185, there is disclosed adjusting the position of the full load stop by sensing the density of the fuel flow using a swirl-type orifice. U.S. Pat. Nos. 3,170,503, 3,204,623, 3,241,596, and 3,338,224 all disclose a fuel density compensating mechanism utilizing an annular orifice for sensing a pressure drop indicative of the viscosity of the fuel.

The operating principle of the device as disclosed in these patents is that with changes in the density or viscosity between fuels, a pressure difference is created which can be used to do useful work. A fluid motor is subjected to the pressure difference in order to change the position of the maximum fuel stop.

Each of the devices described in the above patents use only a single density/viscosity sensor. In the one series of patents, pressure is regulated to a constant value and then adjusted by means of a trimming valve and then discharged to a drain across the annular clearance formed by a housing bore in an operating piston. This annular clearance becomes viscosity sensitive as a function of the Reynolds number. With changes in density/viscosity the pressure drop across the annular clearance changes and provides a means of driving a fluid motor to regulate the position of the maximum fuel stop.

The device of the 3,215,185 patent utilizes a swirl-type orifice as the viscosity sensor. Again, the fluid pressure changes will change the density of the viscosity and its use to drive a fluid motor which, in turn, alters the position of the maximum fuel stop of the diesel fuel injection pump.

Both of the above devices have a basic fault. Neither device provides a sufficient pressure change as a function of the density/viscosity changes to adequately perform the required task of moving the maximum fuel stop to a new position. The force generated by the viscosity change in either device is marginal.

The principle described herein is the utilization of multiple staged devices in a particular manner to achieve significantly improved fluid pressure change as a function of the fluid density/viscosity variation.

In the herein described device, fluid under pressure enters a fuel inlet and is regulated at a constant pressure by the pressure regulator. The pressure level at the output on the pressure regulator serves to provide a desired pressure level at the bottom of the fluid motor piston which, along with the clearance dimension around the fluid motor piston, keep the Reynolds number of the fluid flow in the viscosity sensitive region.

The fluid then flows through an annular clearance between the fluid motor piston and the piston bore. The fluid pressure of the fluid discharge from the annular clearance to a serve chamber varies with the viscosity and density of the fluid. The fluid then exits the servo chamber across a needle valve and flows to drain pressure through a swirl orifice. The needle valve serves to trim or adjust the servo chamber pressure to the desired pressure for the fluid being used. The desired pressure is that pressure which places the vertical position of the maximum fuel stop at the correct length for the desired fuel The combination of the annular flow clearance passage created by the piston to bore clearance and the swirl-type orifice is different than the previous devices. The annular flow orifice has a flow characteristic such that as the fluid density and viscosity decreases, the pressure drop across the piston decreases. The swirl-type orifice, on the other hand, has a diametrically opposite characteristic since as the fluid density and viscosity decrease, the pressure drop across the swirl orifice increases. Hence, the two viscosity sensitive elements of the device work together to more than double in some cases, the amount of servo pressure change as a function of the density viscosity change. The amount of change is determined by the Reynolds number for the annular flow passageway and all attendant passages. Also the swirl orifice velocity characteristic and Reynolds number can be adjusted for maximum effect by sizing of the tangential passages and discharge orifice length and diameters. By utilizing two sensing devices having diametrically opposing pressure drop characteristics, the compensation device has increased force resulting in improved displacement which results in increased stability and accuracy of the device.

SUMMARY OF THE INVENTION

It is an object of the present invention to provide a fuel compensation device based upon the fuel density and viscosity.

It is a further object of the present invention to cooperatively utilize multiple viscosity sensing devices to provide appropriate fuel control output.

It is a still further object of the present invention to provide means for adjusting the maximum fuel stop in a fuel injection pump based upon the fuel selected and the viscosity of that fuel.

It is still another object of the present invention to provide an economical, reliable and stable fuel compensation device.

Other objects will be apparent from the description to follow and the appended claims.

These and other objects of the present invention are achieved according to a preferred embodiment of the invention by providing a fuel viscosity compensation device for providing an output which may be used to regulate the output of a fuel pump based on the viscosity of the fuel. The device comprises a housing including walls defining a pressure chamber and a fuel inlet; a piston located within the pressure chamber and being capable of reciprocating motion within the pressure chamber, said piston dividing the pressure chamber into a regulated pressure cavity on one side of the piston and a servo pressure chamber on the other side of the piston, said piston being sized relative to the housing walls to define a restricted orifice there between extending from the regulated pressure cavity to the servo pressure to allow fuel to flow therebetween while undergoing a pressure decrease based on the viscosity of the fuel; a piston spring positioned to bias the piston toward the regulated pressure cavity; a pressure regulator connected to receive fuel under pressure from the fuel inlet and to deliver said fuel at a reduced pressure to the regulated pressure cavity; conduit means connected to receive fuel from the servo pressure cavity; swirl means connected to receive fuel from the conduit means for effecting a pressure reduction of the fuel flowing there through dependent upon a viscosity of fuel, thereby affecting the pressure of the fuel in the servo chamber; and fuel control means connected to the piston to be displaced with the piston in response to the viscosity of the fuel to thereby provide an output representative of the fuel viscosity.

Additionally, disclosed is a method of regulating the volumetric fuel flow through a fuel injection pump based on the viscosity of the fuel. The method includes the steps of receiving fuel under pressure and regulating that fuel to a constant lower pressure; supplying said pressure regulated fuel to a regulated pressure cavity to apply a force against a piston biased by a spring; bypassing a portion of the fuel past the piston through a restricted clearance such that the fuel undergoes a pressure drop indicative of the fuel viscosity; collecting the bypass fuel in a servo pressure chamber to apply a force against the piston in the same manner as the spring, said forces causing the piston to reciprocate seeking a balance point between forces, said balance point being indicative of the viscosity of the fuel; controlling the pressure of the fuel in the servo pressure chamber by use of a pressure reduction device which acts to reduce pressure of the fuel depending upon the viscosity of fuel, whereby the combination of the restrictive clearance and the pressure reduction device coact to create sufficient pressure drops based on the viscosity of fuel to cause the piston to be displaced providing an output indicative of the fuel viscosity.

DESCRIPTION OF THE PREFERRED EMBODIMENT

The invention herein will be described with reference to a fuel compensation device specifically designed for use in a fuel injection pump to set the maximum fuel stop. It is to be understood that this invention has applicability to other devices for compensating fluid flow based upon the viscosity of the fluid and to other end uses other than fuel injection pumps.

It is also to be understood that although specific pressure reduction devices are recited herein and claimed that other pressure producing devices could serve to function a identified herein equally well. The annular clearance between the piston and the housing wall serves to create a pressure drop which decreases as the viscosity fluid decreases. Any device which operates in a similar manner could likewise be used. The swirl-type orifice disclosed is a viscosity sensitive device which acts to decrease the pressure drop as the viscosity increases. Another device which would perform the same function could be used equally well.

Figure 1:
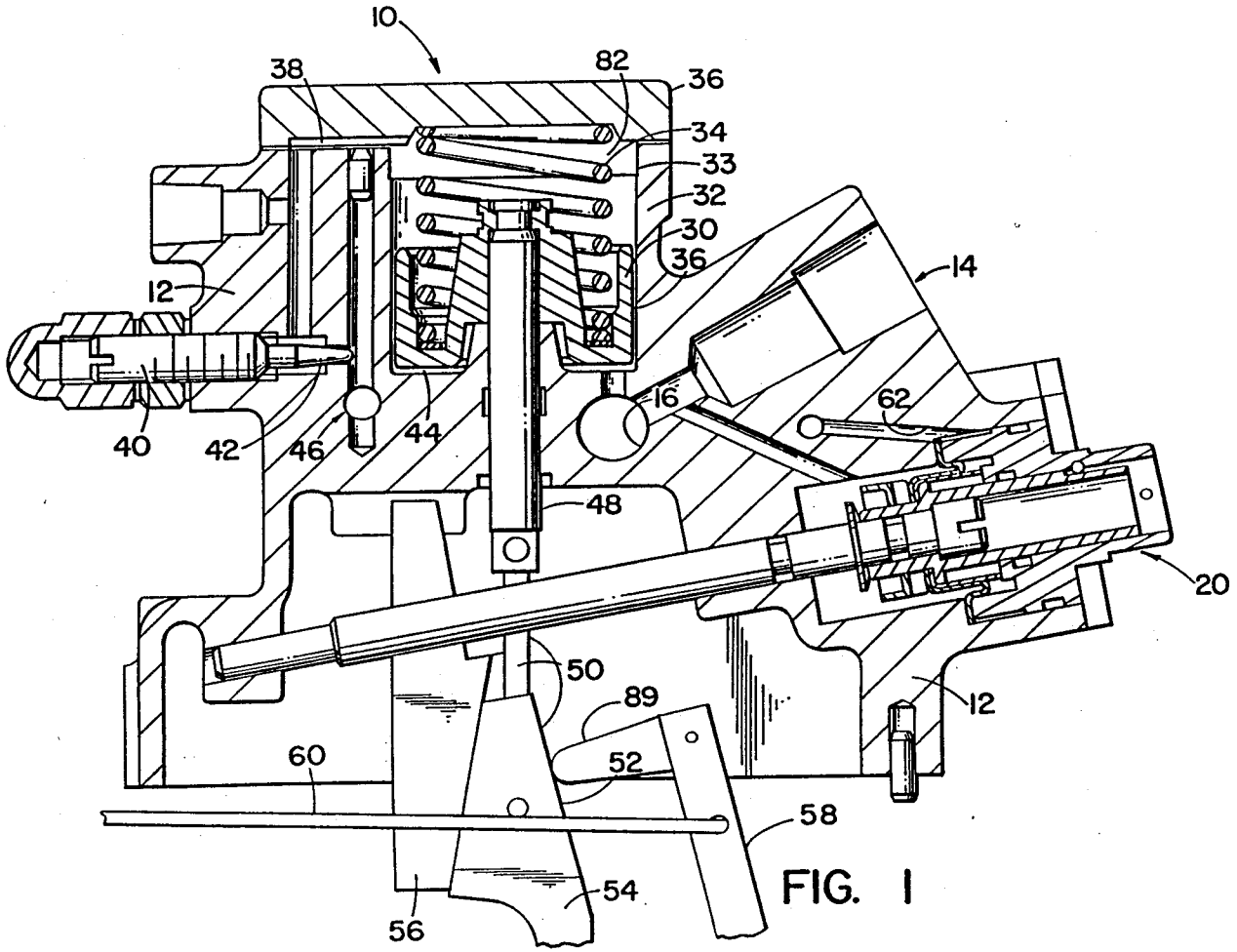
FIG. 1 is a sectional view of a fuel density/viscosity compensation device.

Referring now to FIG. 1, there may be seen a portion of the fuel injection pump 100 including a fuel density and viscosity compensator 10. Housing 12 is shown defining fuel inlet 14 through which the fuel may be supplied from a fuel tank under pressure to the injection pump. Fuel flows through fuel inlet 14 to pressure regulator 16 which acts to decrease the pressure of the fluid and to provide fluid output at constant pressure. Fluid flows therefrom to pressure regulated cavity 44. This cavity is defined between the housing and piston 30 and is an expandable cavity based upon the position of the piston. The fluid within regulated pressure cavity 44 may flow between the exterior cylindrical wall of piston 30 and walls 33 of housing 12 which act to define a pressure chamber 80. The sizing of the exterior dimensions of piston 30 as compared to the walls 33 is critical. The space therebetween is referred to as annular orifice 36. This orifice is kept small in dimension such that as the fuel flows from regulated pressure cavity 44 through annular orifice 36 to servo pressure chamber 82, all within pressure chamber 80, there is a pressure drop. This pressure drop is directly related to the density of the fuel such that as the density of the fuel increases the pressure drop increases.

It may be seen that piston spring 34 is located between cover 36 and piston 30 to apply a downward force on piston 30 as seen in FIG. 1. The pressure of the fuel in servo chamber 82 also acts to apply a downward force against the piston. The pressure of the fuel in regulated pressure cavity 44 acts to provide an upward force against the piston. Hence, based upon this combination of forces, the piston is displaced upwardly or downwardly. Obviously, it may be seen that as the pressure drop of the fuel flowing through annular orifice 36 increases, the force applied by the fuel in servo pressure chamber 82 decreases, hence the spring must absorb more of the force applied by the fuel in regulated pressure cavity 44. Under these circumstances the piston rises. A converse situation would likewise occur as the fuel density decreases the pressure drop of the fuel flowing through the annular orifice 36 would decrease and hence the pressure of the fuel in servo pressure chamber 82 would be closer to the regulated fuel pressure in cavity 44 such that the piston would be caused to move downwardly.

Pressure line 38 is shown connecting the outlet of servo pressure chamber 82 to needle valve 40 having needle 42. Needle valve 40 is utilized to position needle 42 to regulate a pressure drop between pressure line 38 including connected servo pressure chamber 82 and swirl orifice 46.

Swirl orifice 46 is a viscosity sensitive device which acts to tangentially inject the fuel into a central orifice such that the fuel swirls. As the viscosity of the fuel increases the pressure drop through the swirl orifice decreases. Swirl orifice 46 is connected through a line (not shown) to drain line 62 which is connected to atmospheric pressure. Hence, the pressure drop between the swirl orifice and atmospheric pressure actually decreases as the viscosity of the fuel increases. As the pressure drop across swirl orifice 46 decreases, the relative pressure differential between the servo pressure chamber and inlet to the swirl orifice as controlled by the needle valve, remains the same. Hence the pressure in servo pressure chamber 82 would also decrease.

In other words, as an increased viscosity fuel is utilized, its pressure drop across annular orifice 36 would increase thereby decreasing the pressure in servo chamber 82. Additionally, since this increased viscosity fluid flowing through swirl orifice would create a reduced pressure drop across the swirl orifice, the pressure entering the swirl orifice 46 would also decrease thereby further decreasing the pressure in servo pressure chamber 82. Hence, it may be seen that the two viscosity sensitive devices act in conjunction such that there is an increased force applied to the piston.

Piston 30 is connected via piston rod 48 to link 50 which is connected to slidably displace adjustable stop height 54. Adjustable stop height 54 has an inclined surface 52 and slides against stop plate 56. Hence, as the piston reciprocates, the adjustable stop plate also reciprocates and inclined surface 52 acts to displace cam follower 89.

As can be seen in FIG. 1, governor fulcrum lever 58 has cam follower 89 attached thereto which follows inclined surface 52 of the adjustable stop plate 54. As the adjustable stop plate 54 moves up and down, cam follower and governor fulcrum lever 58 are displaced relative thereto. Fuel control rod 60 is connected to governor fulcrum lever 58 and is utilized to set the maximum fuel stop of the fuel injection pump based upon the position of cam follower 89 on inclined surface 52.

Additionally, shown in FIG. 1 is excess fuel assembly 20. It may be seen that high pressure fuel from fuel inlet 14 may be directed thereto as well as low pressure fuel from drain line 62. The purpose of excess fuel assembly 20 is to supply excess fuel to the internal combustion engine during startup.

Figure 3:
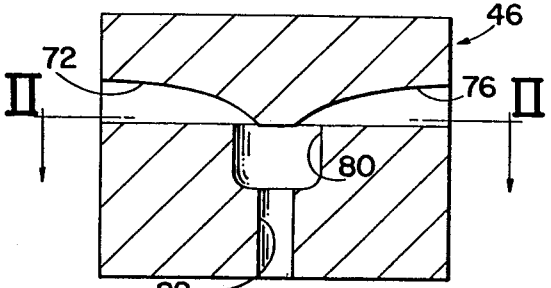
FIG. 3 is a sectional view of a swirl-type orifice taken along line III—III of FIG. 2.
Figure 2:
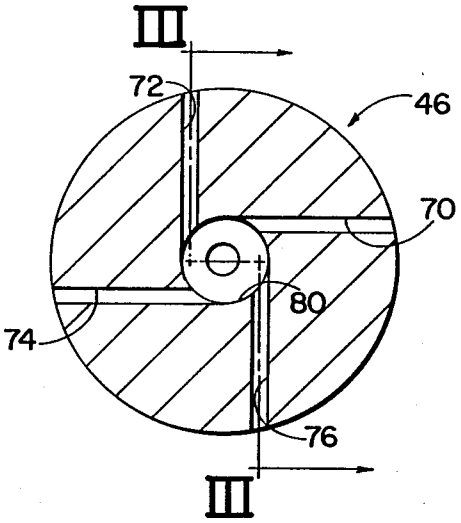
FIG. 2 is a sectional view of a swirl-type orifice taken along the line II—II from FIG. 3.

Swirl orifice 46 may be seen in sectional view in FIGS. 2 and 3. In FIG. 2 it may be seen that there are a series of four tangential slots referenced 70, 72, 74 and 76 wherein the fuel enters tangentially into a vertically extending swirl chamber 80. The utilization of this type of entry creates a swirling effect to create an air column such that as the density of the fluid increases, the pressure drop through the swirl orifice decreases.

FIG. 3 is a sectional view of FIG. 2 taken along the line III—III and shows the manner in which tangential slots 72 and 76 are located relative to swirl chamber 80 and outlet 82.

Figure 4:
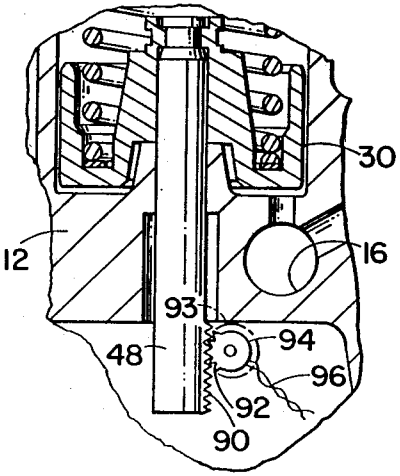
FIG. 4 is a partial, sectional view of a portion of the fuel density compensation device.

FIG. 4 is a partial view of a portion of the fuel compensation device showing pressure regulator 16, piston 30, housing 12 and piston rod 48. In this embodiment rack teeth 90 are shown located in the surface of piston 48. Rack teeth 90 coact with pinion teeth 92/pinion gear 93 connected to potentiometer 94. Wires 96 are shown extending from potentiometer 94 and may be utilized to conduct an output signal from the potentiometer which is indicative of the position of the piston. In this manner the necessity of employing a large physical force of the piston may be obviated by electrically sensing the position of the piston and controlling the fuel stop or other fuel regulation device in response thereto. The necessary sizing of the components may be dramatically decreased should mere electronic position sensing be appropriate. When force is not a critical factor, the utilization of both the annular orifice and the swirl orifice as viscosity sensitive devices, still aids in the stability of the system and improves the results of the viscosity sensing even though the increased force is not required.

The invention has been described with reference to a particular embodiment. It is to be understood by those skilled in the art that variations and modifications can be effected within the spirit and scope of the invention.

I claim:

1. A fuel viscosity compensating device for providing an output which may be used to regulate the output of a fuel pump based on the viscosity of the fuel which comprises:

a housing including walls defining a pressure chamber and a fuel inlet;

a piston located within the pressure chamber and being capable of reciprocating motion within the pressure chamber, said piston dividing the pressure chamber into a regulated pressure cavity on one side of the piston and a servo pressure chamber on the other side of the piston, said piston being sized relative to the housing walls to define a restricted orifice there between extending from the regulated pressure cavity to the servo pressure cavity to allow fuel to flow there between while undergoing a pressure decrease based on the viscosity of the fuel;

a piston spring positioned to bias the piston toward the regulated pressure cavity;

a pressure regulator connected to receive fuel under pressure from the fuel inlet and to deliver said fuel at a reduced pressure to the regulated pressure cavity;

conduit means connected to receive fuel from the servo pressure cavity;

swirl means connected to receive fuel from the conduit means for effecting a pressure reduction of the fuel flowing there through dependent upon the viscosity of fuel thereby effecting the pressure of the fuel in the servo chamber; and fuel control means connected to the piston to be displaced with the piston in response to the viscosity of the fuel to thereby provide an output representative of the fuel viscosity.

2. The apparatus as set forth in claim 1 wherein the conduit means further comprises a needle valve for providing an additional pressure drop for the fuel flowing there through, said needle valve acting as an adjusting valve to zero said output.

3. The apparatus as set forth in claim 1 wherein the fuel control means further comprises a stop plate assembly connected to the piston and having an inclined surface and a cam follower connected to a fuel control rod for regulating fuel flow, said cam follower riding on the inclined surface to adjust the fuel flow based on the position of the piston and the stop plate assembly.

4. The apparatus as set forth in claim 1 wherein the piston is cylindrical in configuration and the orifice is annular in configuration.

5. The apparatus as set forth in claim 1 and further comprising electrical position sensing means positioned to detect the displacement of the piston and generate an output signal indicative thereof.

* * * * *